US007410176B1

(12) United States Patent
Terminella et al.

(10) Patent No.: US 7,410,176 B1
(45) Date of Patent: Aug. 12, 2008

(54) CORE CHUCK WITH POSITIVE ENGAGEMENT

(75) Inventors: Emanuele Terminella, Fayetteville, AR (US); Frank Terminella, Fayetteville, AR (US); Joseph Terminella, Fayetteville, AR (US)

(73) Assignee: Pacmac, Inc., Fayetteville, AR (US)

( * ) Notice: Subject to any disclaimer, the term of this patent is extended or adjusted under 35 U.S.C. 154(b) by 467 days.

(21) Appl. No.: 11/208,397

(22) Filed: Aug. 19, 2005

(51) Int. Cl.
*B23B 31/00* (2006.01)

(52) U.S. Cl. ..... 279/158; 279/83; 242/570

(58) Field of Classification Search ..... 242/596.7, 242/573.6, 571.3, 613, 599.3, 599, 597.1, 242/597, 575.3; 279/83; 403/344, 313, 312, 403/310, 337, 62, 370
See application file for complete search history.

(56) References Cited

U.S. PATENT DOCUMENTS

| | | | | | |
|---|---|---|---|---|---|
| 566,368 | A * | 8/1896 | Wuelfing | 242/575.3 |
| 1,402,060 | A | 1/1922 | Fisher | |
| 2,922,592 | A | 1/1960 | Kaltenbach | 242/68.2 |
| 3,310,252 | A * | 3/1967 | Ewing | 242/575 |
| 3,368,769 | A | 2/1968 | Obenshain | 242/68.4 |
| 3,623,741 | A * | 11/1971 | Reeder et al. | 279/2.2 |
| 3,704,837 | A | 12/1972 | Heinz et al. | 242/68.2 |
| 3,881,666 | A * | 5/1975 | Greenhalgh | 242/571.3 |
| 3,993,317 | A * | 11/1976 | Flagg | 279/2.19 |
| 4,045,038 | A * | 8/1977 | Obenshain | 279/2.24 |
| 4,519,620 | A * | 5/1985 | Keith | 279/2.2 |
| 4,610,585 | A * | 9/1986 | Fellmeth et al. | 279/83 |
| 5,997,012 | A * | 12/1999 | Brian | 279/43.5 |
| 6,224,067 | B1 * | 5/2001 | Lindstrom | 279/43 |
| 2004/0256518 | A1 * | 12/2004 | Hope | 242/571 |

* cited by examiner

*Primary Examiner*—J. Allen Shriver
*Assistant Examiner*—Juan J Campos
(74) *Attorney, Agent, or Firm*—Keisling Pieper & Scott PLC; Robert R. Keegan; Trent C. Keisling

(57) ABSTRACT

There is disclosed chuck configurations for internally engaging the hollow core element of a roll of packaging or printing sheet or other web material in which a generally cylindrical chuck body insertable in a web core has at least one hole through the chuck body at an acute angle with the tangent to the chuck body at the outer entrance point of the hole and at an acute angle with the plane perpendicular to the chuck cylindrical axis. At least one elongated element is configured to engage rotatably in each of the holes and having on a distal end thereof one or more pointed or toothed extensions for engagement with the interior of a hollow web whereby chuck engagement with a hollow core may be made by manipulating such elongated elements to extend outside the periphery of said chuck body. The chuck may also be provided with means for securing it on a spindle or shaft for rotation therewith which is separate and independent of the holes and elongated elements for engaging the hollow core.

20 Claims, 4 Drawing Sheets

CORE CHUCK WITH POSITIVE ENGAGEMENT

CROSS-REFERENCE TO RELATED APPLICATIONS

Not applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

The present invention relates to an improved core chuck for hollow roll cores, particularly as used with rolls of packaging films, paper and other web material, but not limited thereto.

In the paper, plastic, printing and related industries, paper, plastic or other sheet material in web form is often handled in the form of rolls of the material wound onto hollow paperboard, fiber or plastic cores. Although some cores may have a notch or key opening in one or both ends for engagement by a key. Such a notch or key opening is not required for chucks which fit into and engage the hollow interior of the core. In any case, cores secured in a core can be suitably driven for winding or unwinding the material. With keyed web cores, often core ends are damaged or key slots are mutilated which renders a key of a core chuck unsatisfactory for keeping the core firmly secured for winding and unwinding. The core chuck of the present invention does not rely on the presence or absence of a notch in the core.

Different keyless chuck expedients have been proposed including expanding chucks, tapered chucks with fluted surfaces and chucks with internal core restraints which tilt, expand or extend into position. However, these expedients have provided core chucks that are quite expensive, difficult to maintain and use, and often unsatisfactory in performance.

Some of the prior art core chucks are exemplified in the following U.S. Pat. Nos. 1,402,060; 2,922,592; 3,368,769; 3,704,837; and 4,045,038.

The above noted U.S. Pat. Nos. 1,402,060, 2,922,592 and 3,704,837 each work on the principle whereby internal core restraining devices are forced into position automatically by mechanical action as the core is inserted on the chuck, while prior U.S. Pat. No. 3,368,769 uses a floating key arrangement for accommodating different sized cores. Later U.S. Pat. No. 4,045,038 utilizes chuck dogs that are normally spring biased into a retracted condition, but which can be engaged into the hollow core by a separate mechanical action not inherent with the placing of the core on the chuck.

In contrast, it will be seen that the core chuck of the present invention provides at least one elongated element residing in an angularly situated hole extending into the core enclosed chuck portion and which can be manipulated to extend outside the chuck periphery to engage positively with the core interior. Thus rotational unity between chuck and core is secured by a simple and reliable mechanism overcoming disadvantages of the prior chuck devices. The core of the present invention is particularly useful with damaged or poorly made cores, and commendably satisfies a need for a simple, easy-to-employ device of rugged construction.

BRIEF SUMMARY OF THE INVENTION

Core chucks according to the present invention are characterized by configurations for internally engaging the hollow core element of a roll of packaging or printing sheet or other web material in which a generally cylindrical chuck body insertable in a web core has one or more holes through the chuck body at an acute angle with the tangent to the chuck body at the outer entrance point of the hole and at an acute angle with the plane perpendicular to the chuck cylindrical axis. At least one elongated element is configured to engage rotatably in each of the holes and has on a distal end thereof one or more pointed or toothed extensions for engagement with the interior of a hollow web, whereby chuck engagement with a hollow core may be made by manipulating such elongated elements to extend outside the periphery of said chuck body engaging an interior surface of the hollow core. The chuck is also typically, provided with means for securing it on a spindle or shaft for rotation therewith which is separate and independent of the holes and elongated elements for engaging with the hollow core.

DETAILED DESCRIPTION OF THE INVENTION

Figure 1:
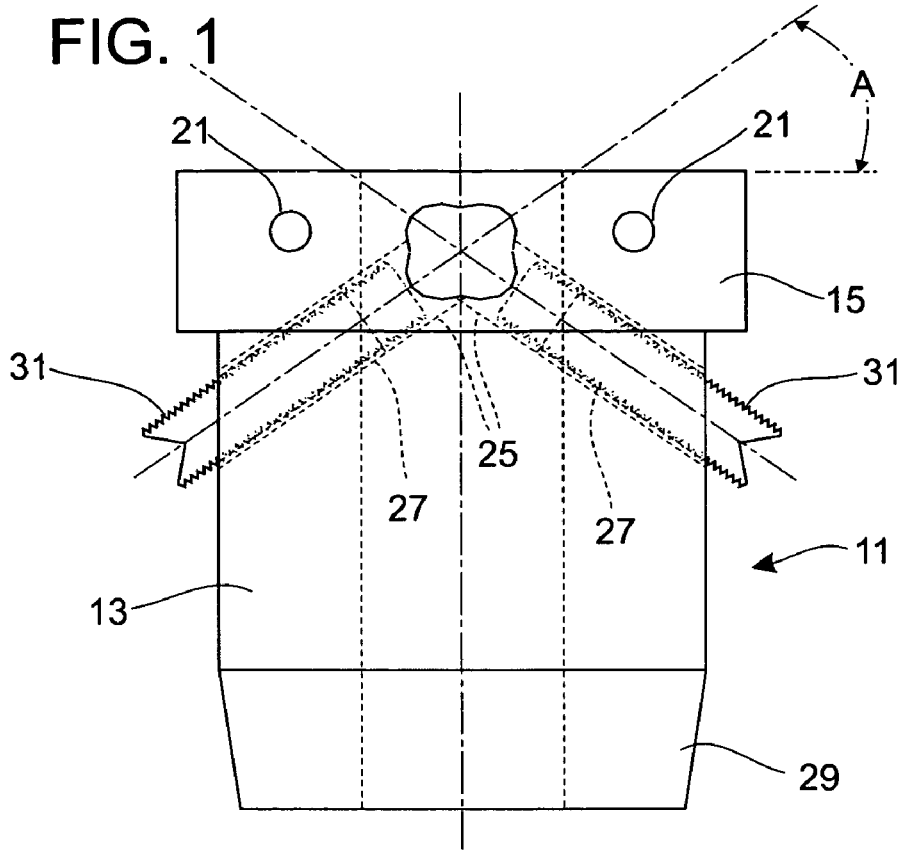
FIG. 1 is a front elevational view of a preferred embodiment of a core chuck according to the present invention.
Figure 2:
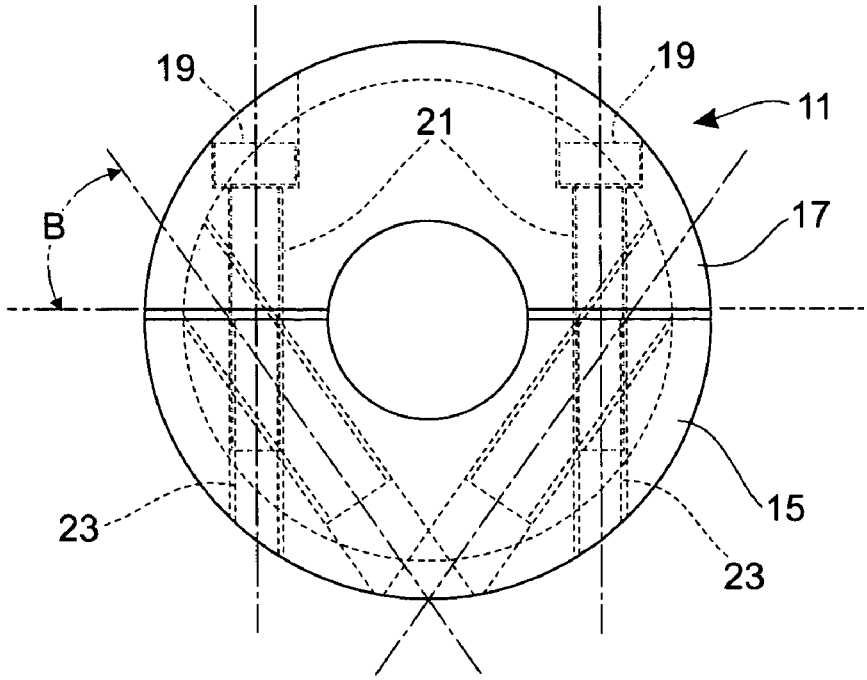
FIG. 2 is a top plan view of the core chuck of FIG. 1.
Figure 3:
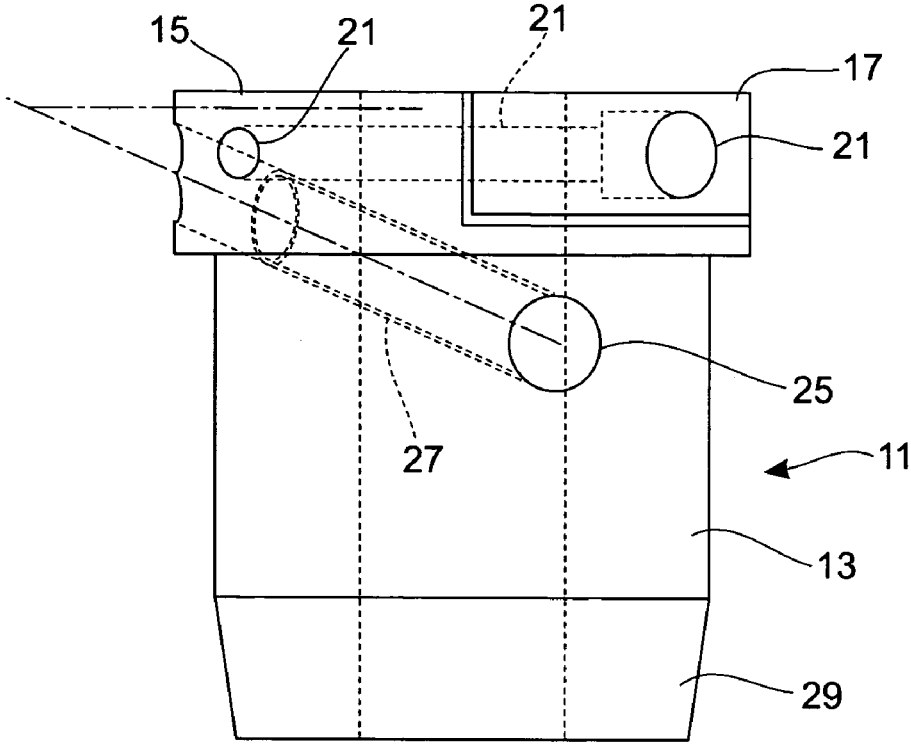
FIG. 3 is a side elevational view of the core chuck of FIG. 1 and FIG. 2.
Figure 4:
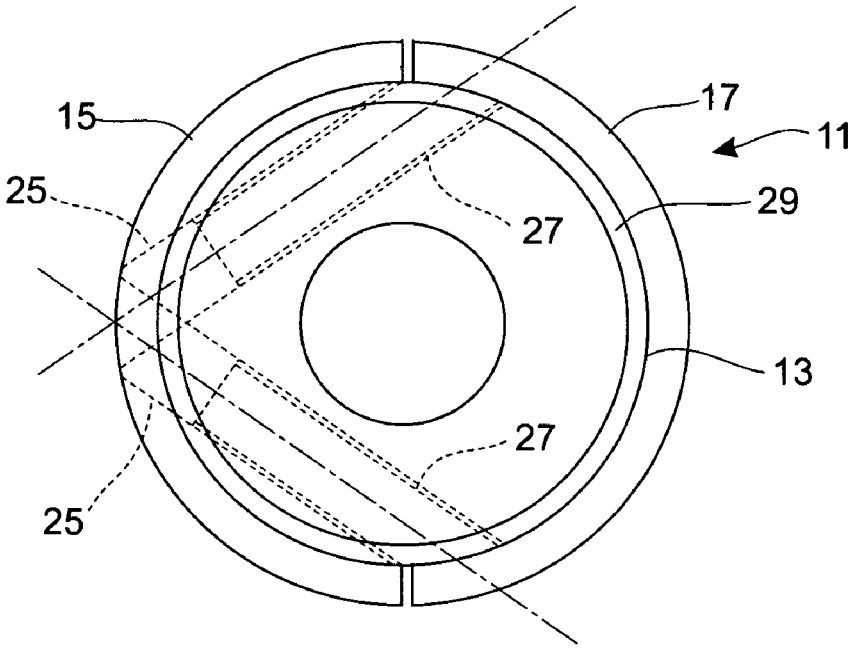
FIG. 4 is a bottom plan view of the core chuck of FIGS. 1-3.
Figure 5:
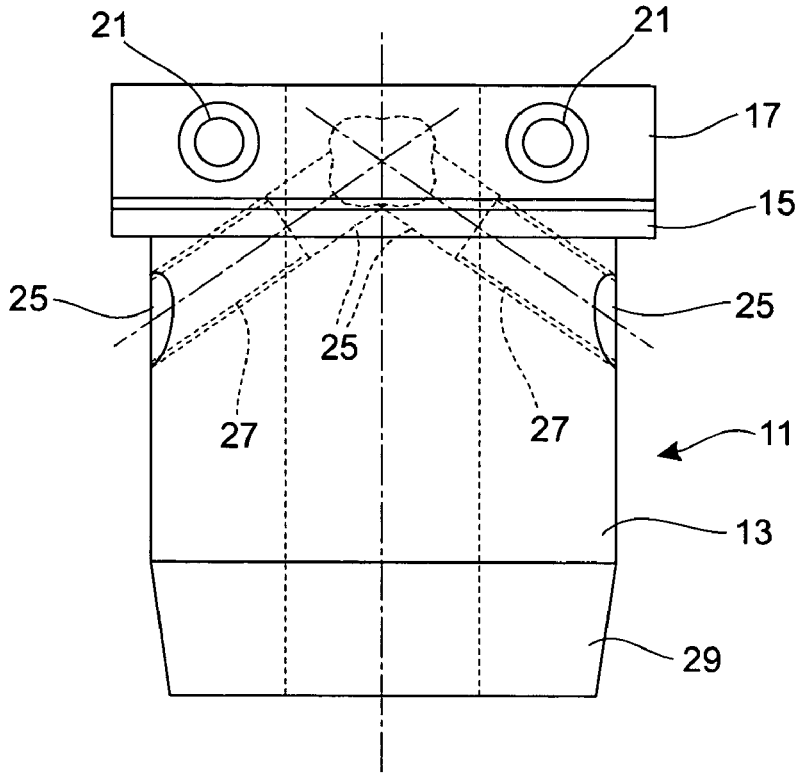
FIG. 5 is a rear elevational view of the core chuck of FIGS. 1-4.
Figure 6:
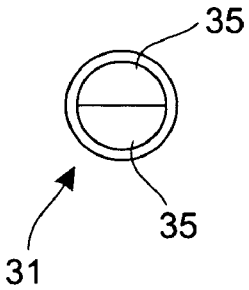
FIG. 6 is an enlarged front end view of a first embodiment of a threaded engagement element suitable for employment in the core chuck of FIGS. 1-5.
Figure 7:
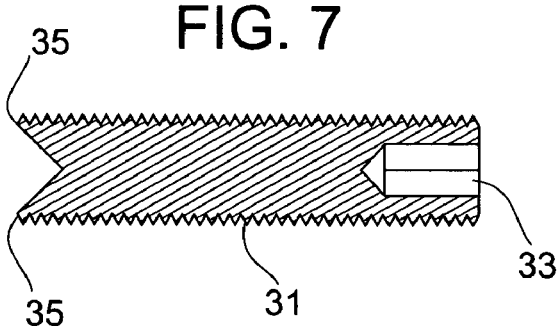
FIG. 7 is a side elevational view of the engagement element of FIG. 6.
Figure 8:
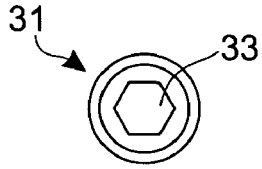
FIG. 8 is a rear end view of the engagement element of FIGS. 6 and 7.
Figure 9:
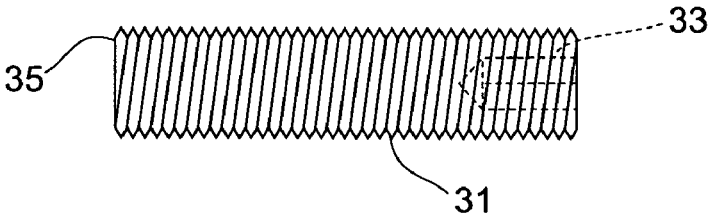
FIG. 9 is a top plan view of the engagement element of FIGS. 6-8.

FIGS. 1, 2, 3, 4 and 5 illustrate the front, top, side, bottom and rear views of a core chuck embodying the present invention. Referring to FIGS. 1-5, a core chuck 11 is shown for internally engaging the hollow core element of a roll of plastic, paper or other web material. Chuck 11 comprises a cylinder portion 13 with a diameter slightly less than the inside diameter of a hollow core element for which it is to be used. Usually the chuck body of chuck 11 also includes a base portion 15 having an opening for accepting the chuck coaxially on a spindle, shaft, or other rotating support.

In most implementations of the core chuck it will be desired to have the core chuck rotate with a spindle or shaft for winding and unwinding web material. Accordingly, a clamp 17 is provided with two parts one of which is integral with or affixed to said base portion and the other of which is securable in place by screws to clamp on a spindle or shaft. In FIGS. 1-5, this clamp arrangement is implemented with clamp screws 19 passing through clamp screw holes 21, which are provided with screw hole threads 23. Although various other clamping arrangements could be employed for the core chuck, the arrangement illustrated makes it simple and convenient to tighten screws 19 to draw clamp 17 into tight frictional engagement with a spindle or a shaft serving to rotate chuck 11 for winding or unwinding web material.

As previously mentioned, cylinder portion 13 will be slightly smaller in diameter than the internal diameter of a core element of a roll of web material, and novel means is provided by the present invention to restrain relative rotation between the core element of a roll of web material and core chuck 11. As shown in FIGS. 1-5, the body of core chuck 11 is provided with two bore holes 25, each of which is provided with bore hole threads 27 in a portion thereof. Best restraint and effective operation of the core chuck is obtained with two bore holes as shown in FIGS. 1-5 but in some instances only a single bore hole might be employed.

It will be noted that bore holes 25 central axes are arranged at a particular angle B with respect to both the diametral plane and a plane tangent to the cylinder at the bore holes entrance point and also at a particular angle A with respect to a plane perpendicular to the cylinder central axis. Preferably angle A is between 20 degrees and 60 degrees and angle B is between 30 degrees and 70 degrees. For example, angle A may be approximately 35 degrees and angle B may be approximately 55 degrees. If desired, the chuck 11 may be provided with a tapered portion 29 to facilitate insertion of the chuck in a hollow core element.

An exemplary form of engagement element 31 is shown in place in FIG. 1, for example. Engagement element 31 is also referred to as a threaded element and is shown in more detail in FIGS. 6-9. In those figures it will be noted that threaded element 31 is provided with a recess 33 (as a tool engageable configuration). The engagement element 31 may thus readily be rotated with a hex wrench or other tool to partially extend outside the cylinder portion 13 causing one of tooth-like extensions 35 on engagement element 31 to gouge into or otherwise positively engage a core element of a roll of web material having the chuck 11 inserted therein. For clarity, a core element is now shown on chuck 11, but it will be understood that a typical core element may be a hollow cylinder of 3 inch i.d. and wall thickness of ⅛ to ¼ inch. The threaded element may be about one-half inch in diameter with threads about 10 to 20 per inch.

A threaded engagement element 31 will typically have threads of 10 or more to the inch. With this arrangement it will be desirable to rotate the engagement element one full turn, or more. after first contacting the interior of the hollow core element with one of the extensions 35. It will be noted that there are two tooth-like extensions 35 on the engagement element 31 which each have serrations due to the grooves between teeth of the threaded engagement element 31. If desired, additional serrations may be cut in the extension of engagement element 31. The engagement elements 31 are rotated clockwise to advance past preliminary contact with the interior of the hollow core element until further rotation is resisted.

While the tooth-like extensions of engagement element 31 are well adapted to provide good and secure engagement of the inside of the hollow core element with which the core chuck is being used, variations could be made to provide three or more of the wedge shaped extensions and/or a greater number of serrations beyond those inherently provided by the grooves of the threads at edges of the extension.

Figure 10:
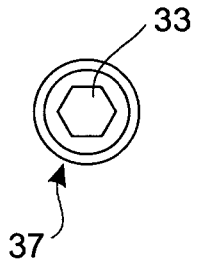
FIG. 10 is an enlarged rear end view of a second embodiment of a threaded engagement element suitable for employment in the core chuck of FIGS. 1-5.
Figure 11:
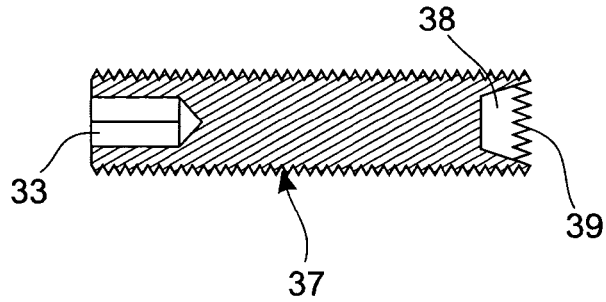
FIG. 11 is a side elevational view of the engagement element of FIG. 10.
Figure 12:
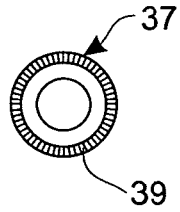
FIG. 12 is a front end view of the engagement element of FIGS. 10 and 11.

FIGS. 10-12 show an alternative form of engagement element 37 which is provided with a recess 33 for engagement with a conventional hex wrench in a manner similar to that shown for engagement element 31 in FIGS. 6-9. Engagement element 37 is provided on the distal end thereof with a conical depression 38 shown in dashed lines. A multiplicity of teeth 39 is formed around the periphery of the distal and of engagement element 37. When engagement element 37 is employed, the numerous teeth 39 serve to provide a firm engagement when the penetration of the teeth may not be as great as in other embodiments of the engagement element.

Figure 13:
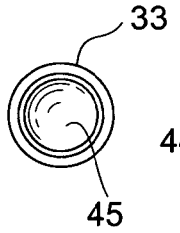
FIG. 13 is an enlarged front end view of a third embodiment of a threaded engagement element suitable for employment in the core chuck of FIGS. 1-5.
Figure 14:
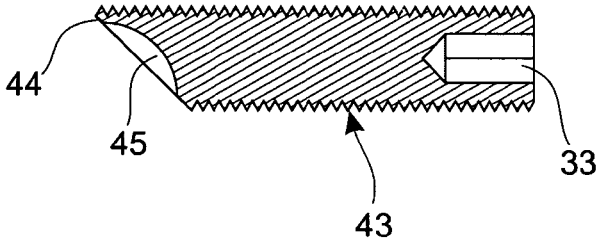
FIG. 14 is a side elevational view of the engagement element of FIG. 13.
Figure 15:
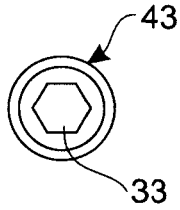
FIG. 15 is a rear end view of the engagement element of FIGS. 13 and 14.

A further alternative form of engagement element 43 is illustrated in FIGS. 13-15 and it is characterized by concavity 45 which serves to make the cutting or gouging edge of engagement element 43 sharper and better able to penetrate the interior surface of a hollow core element with a few turns of engagement element 43. Concavity 45 may take the form of a spherical or other dished out depression, other than having the concavity 45, engagement element 43 is generally similar to others with a recess 33 for engagement by a tool. Threads for extension engagement element 43 may help to gouge and engage a hollow core element.

Although the engagement element 43 and other threaded engagement elements are shown with the threads extending the full length of the engagement element, it may be desirable for the threads to extend only a portion of the way from the proximal end so that the shape of the extension 44 can be made serrated smooth or otherwise determined separate and apart from the effect of thread peaks and grooves. Also while a single extension 44 is shown for engagement element 43 it will be apparent that more than one such extension could be provided as was the case with other engagement elements.

It will be apparent to those skilled in the art that numerous other variations may be made within the scope of the invention. For example, the preferred embodiment shows an arrangement with two bore holes having a common entry opening, but the arrangement could include a lesser or greater number of bore holes and the arrangement of the bore holes could be other than with a common entry opening.

The clamp arrangement for the core chuck is only one of numerous clamp arrangements that could be adapted from the prior art to perform the function of making the core chuck frictionally or otherwise secured to rotate with a driving spindle or shaft.

Also, the diversity of engagement elements illustrated and described is only representative, and these elements can have numerous other variations that will be apparent to those skilled in the art. As previously mentioned, the elements may only be partially threaded rather than fully threaded or a threadless locking and latching mechanism could be substituted for the screw thread arrangement. The engagement elements may of course be arranged to cooperate with some other form of tool rather than a hex wrench, but the almost universal availability of hex wrenches recommends that form of tool. Each engagement element such as 31 could be formed in two parts with the distal part of each element rotatably affixed to the proximate threaded portion whereby the distal extended or toothed portion would not rotate in the engagement process. While the gouging action of some of the illustrated engagement elements is found to be quite effective, the gouging engagement is not necessary to the essence of the invention. In particular, where an engagement element had two parts one of which does not rotate, the desired restraint could be achieved primarily by the frictional engagement of an inner surface of a hollow core element with the outer portion of a partially threaded engagement element. Primarily frictional or solely frictional engagement would be rendered more effective by the double bore hole preferred embodiment illustrated in FIGS. 1-5.

In addition to the variations and modifications illustrated, described, or suggested it will be apparent to those of ordinary skill in the art that numerous other variations may be made within the scope of the invention and accordingly the scope of the present invention is not to be limited to the illustrated embodiments but is to be determined by reference to the appended claims.

What is claimed is:

1. A chuck for internally engaging the hollow core element of a roll of web material comprising:

a chuck body having a cylinder portion with diameter slightly less than the inside diameter of a hollow core element with which said cylinder portion is to be used and a base portion with a diameter at least as great as that of said cylinder portion;

said base portion having an opening for accepting said chuck coaxially on a spindle;

said chuck body having at least one partially tapped bore hole through said chuck body with a bore hole central axis line which, projected on a plane perpendicular to the cylinder portion axis, makes an acute angle (B) with a plane tangent to the cylinder at the outer entrance point of said bore, said central axis line further making an acute angle (A) with the plane perpendicular to said cylinder portion axis, the angle (A) being between 20 degrees and 60 degrees and the angle (B) being between 30 degrees and 70 degrees; and at least one threaded element configured to engage rotatably in said tapped bore hole having on a proximal end thereof a tool engageable configuration and on a distal end thereof at least two peripherally located tooth-like extensions for gouging engagement with the interior of a hollow core element;

whereby gouging engagement with a core element is produced by rotational advancement of such a said threaded element to extend outside the periphery of said body cylinder portion.

2. A chuck as recited in claim 1 wherein said base portion is at least in part of generally cylindrical shape concentric with said cylinder portion and having a diameter at least as great as the outside diameter of a core element with which it is intended to be used.

3. A chuck as recited in claim 1 wherein said base portion includes a clamp having a generally toroidal portion and at least one clamp screw arranged to secure said base portion on a spindle or shaft to restrain relative rotation between said chuck and said spindle or shaft.

4. A chuck as recited in claim 1 wherein said base portion includes a clamp having a toroidal portion of two parts, one of which is permanently affixed to said base portion and the other of which is securable in place by screws to clamp on a spindle or shaft to frictionally resist relative rotation between said chuck and said spindle or shaft.

5. A chuck as recited in claim 1 wherein said chuck has an axial hole extending through said chuck to accept a shaft and the difference between the radius of said axial hole and the radius of said cylindrical portion is greater than the diameter of said bore hole.

6. A chuck as recited in claim 3 wherein said tool engageable configuration of said threaded element includes a recess shaped to receive a hex wrench tool.

7. A chuck as recited in claim 6 wherein said clamp screw is recessed to receive the same hex wrench tool as is said threaded element.

8. A chuck as recited in claim 1 wherein said bore hole has an entry opening entirely in said base portion and an exit opening entirely in said cylinder portion.

9. A chuck as recited in claim 1 wherein said an end of said cylinder portion opposite said base portion is slightly tapered to facilitate insertion in a core element.

10. A chuck for internally engaging the hollow core element of a roll of web material comprising:

a chuck body having a cylinder portion with diameter slightly less than the inside diameter of a hollow core element with which said cylinder portion is to be used and a base portion with a diameter at least as great as that of said cylinder portion;

said base portion having a clamp for securing said chuck coaxially on a spindle;

said chuck body having two partially tapped bore holes through said chuck body each with a bore hole central axis line which, projected on a plane perpendicular to the cylinder portion axis, makes an acute angle (B) with a plane tangent to the cylinder at the outer entrance point of said bore, each said central axis line further making an acute angle (A) with the plane perpendicular to said cylinder portion axis, the angle (A) being between 20 degrees and 60 degrees and the angle (B) being between 30 degrees and 70 degrees; and at least one threaded element configured to engage rotatably in each said tapped bore hole having on a proximal end thereof a tool engageable configuration and on a distal end thereof at least two peripherally located tooth-like extensions for gouging engagement with the interior of a hollow core element;

whereby gouging engagement with a core element is produced by rotational advancement of such a said threaded element to extend outside the periphery of said body cylinder portion.

11. A chuck as recited in claim 10 wherein said base portion is at least in part of generally cylindrical shape concentric with said cylinder portion and having a diameter at least as great as the outside diameter of a core element with which it is intended to be used.

12. A chuck as recited in claim 10 wherein said clamp includes a generally toroidal portion of two parts, one of which is permanently affixed to said base portion and the other of which is securable in place by screws to clamp on a spindle or shaft to restrain relative rotation between said chuck and said spindle or shaft.

13. A chuck as recited in claim 11 wherein said clamp includes a generally toroidal portion of two parts, one of which is permanently affixed to said base portion and the other of which is securable in place by screws to clamp on a spindle or shaft to restrain relative rotation between said chuck and said spindle or shaft.

14. A chuck as recited in claim 10 wherein said chuck has an axial hole extending through said chuck to accept a shaft and the difference between the radius of said axial hole and the radius of said cylindrical portion is greater than the diameter of each said bore hole.

15. A chuck as recited in claim 10 wherein said tool engageable configuration of said threaded element is a recess shaped to receive a hex wrench tool.

16. A chuck as recited in claim 15 wherein said clamp includes two screws for tightening said clamp and said screws are recessed to receive the same hex wrench tool as is said threaded element.

17. A chuck as recited in claim 10 wherein each said bore hole has an entry opening entirely in said base portion and an exit opening entirely in said cylinder portion.

18. A chuck as recited in claim 10 wherein said an end of said cylinder portion opposite said base portion is slightly tapered to facilitate insertion in a core element.

19. A chuck for internally engaging a hollow core element comprising:

a chuck body having a cylinder portion with transverse dimension slightly less than the inside diameter of a hollow core element with which said cylinder portion is to be used and a base portion with a transverse dimension greater than that of said cylinder portion;

said base portion being configured to accept said chuck coaxially on a spindle or shaft;

said chuck body having at least two bore holes through said chuck body each with a bore hole central axis line which, projected on a plane perpendicular to the cylinder portion axis, makes an acute angle (B) with a plane tangent to the cylinder at the outer entrance point of said bore, each said central axis line further making an acute angle (A) with the plane perpendicular to said cylinder axis, the angle (A) being between 20 degrees and 60 degrees and the angle (B) being between 30 degrees and 70 degrees; and engagement elements configured to reside in each said bore hole and each having on a distal end thereof a pointed extension adapted to be forcefully contacted with the interior of a hollow core element;

whereby forceful contact with a core element produced by advancement of such engagement elements to extend outside the periphery of said cylinder portion will restrain relative rotation between said chuck and said core element.

20. A chuck as recited in claim 19 wherein said bore holes are two in number and have a common entry hole in said base portion with one bore hole extending clockwise and another bore hole extending counterclockwise in said cylinder portion.

* * * * *